US007739770B2

(12) United States Patent
Tanaka et al.

(10) Patent No.: US 7,739,770 B2
(45) Date of Patent: Jun. 22, 2010

(54) HANDY MOP

(75) Inventors: Yoshinori Tanaka, Kawaga (JP); Masaho Hayashi, Tokyo (JP); Toshihiko Uenishi, Tokyo (JP)

(73) Assignee: Uni-Charm Corporation, Ehime (JP)

( * ) Notice: Subject to any disclaimer, the term of this patent is extended or adjusted under 35 U.S.C. 154(b) by 527 days.

(21) Appl. No.: 10/399,675

(22) PCT Filed: Oct. 25, 2001

(86) PCT No.: PCT/JP01/09377

§ 371 (c)(1),
(2), (4) Date: Apr. 15, 2003

(87) PCT Pub. No.: WO02/34101

PCT Pub. Date: May 2, 2002

(65) Prior Publication Data

US 2004/0034956 A1 Feb. 26, 2004

(30) Foreign Application Priority Data

Oct. 27, 2000 (JP) ..... 2000-328865
Oct. 16, 2001 (JP) ..... 2001-317660

(51) Int. Cl.
*A47L 13/20* (2006.01)

(52) U.S. Cl. ..... 15/228; 15/209.1

(58) Field of Classification Search ..... 15/228, 15/229.1, 229.2, 229.3, 229.4, 229.7, 229.8, 15/247, 145, 147.1, 147.2
See application file for complete search history.

(56) References Cited

U.S. PATENT DOCUMENTS 748,367 A * 12/1903 Haight ..... 15/210.1
1,437,145 A * 11/1922 Johnson ..... 15/210.1
1,437,245 A 11/1922 Hinchcliff
2,262,888 A 11/1941 Dodge
2,877,482 A * 3/1959 Roy ..... 15/220.3
D207,258 S 3/1967 Rippl
3,385,416 A 5/1968 Frechette
3,495,918 A * 2/1970 Leland ..... 401/201

(Continued)

FOREIGN PATENT DOCUMENTS

CN 2192139 Y 3/1995

(Continued)

OTHER PUBLICATIONS

English computer generated translation of JP 10-225409, Aug. 1998.*

(Continued)

*Primary Examiner*—Laura C Guidotti
(74) *Attorney, Agent, or Firm*—Brinks Hofer Gilson & Lione

(57) ABSTRACT

Disclosed is a handy mop including a mop body for collecting dust and a handle to which the mop body is to be attached. The mop body is provided with two gaps (b) extending in parallel for attachment of the handle thereto. The handle is provided with an attachment portion and a gripper extending rearwardly upwardly from a root end of the attachment portion. The attachment portion is bifurcated at the root end to provide two insert plates, which are flat and level, and are to be inserted into the gaps (b) of the mop body for use.

13 Claims, 6 Drawing Sheets

U.S. PATENT DOCUMENTS

| | | | | |
|---|---|---|---|---|
| 4,010,511 | A | 3/1977 | Komatsu | |
| 4,248,660 | A | 2/1981 | Johnson | |
| 4,827,556 | A * | 5/1989 | Corsetti | 15/244.1 |
| 5,010,615 | A * | 4/1991 | Carter | 15/104.94 |
| 5,426,810 | A | 6/1995 | Rones | |
| 6,047,435 | A | 4/2000 | Suzuki et al. | |
| 6,079,075 | A | 6/2000 | Velez-Juan | |
| D441,007 | S | 4/2001 | Simons et al. | |
| D479,375 | S | 9/2003 | Gringer et al. | |
| 6,813,801 | B2 * | 11/2004 | Tanaka et al. | 15/229.3 |
| 6,978,509 | B2 | 12/2005 | Lin et al. | |
| 2004/0034956 | A1 | 2/2004 | Tanaka et al. | |
| 2005/0005381 | A1 * | 1/2005 | Tanaka et al. | 15/147.2 |
| 2005/0144749 | A1 | 7/2005 | Yamada | |

FOREIGN PATENT DOCUMENTS

| | | | |
|---|---|---|---|
| FR | 1148943 | | 12/1957 |
| FR | 1487987 | | 7/1967 |
| HU | P3403843 | | 8/1995 |
| HU | P9700252 | | 10/1997 |
| JP | 39-608 | | 1/1964 |
| JP | 39-6833 | | 3/1964 |
| JP | 39-20632 | | 7/1964 |
| JP | 40-18878 | | 7/1965 |
| JP | 41-14463 | | 7/1966 |
| JP | 41-14464 | | 7/1966 |
| JP | 49-69262 | | 9/1977 |
| JP | 58-177071 | U | 11/1983 |
| JP | 58-194770 | | 12/1983 |
| JP | 60-63157 | A | 5/1985 |
| JP | 60-63158 | A1 | 5/1985 |
| JP | 61-177575 | | 8/1986 |
| JP | 61-177576 | | 8/1986 |
| JP | 62-47351 | A1 | 3/1987 |
| JP | 62-184851 | | 8/1987 |
| JP | 63-121065 | | 5/1988 |
| JP | 1-66267 | U | 4/1989 |
| JP | 1-79454 | | 5/1989 |
| JP | 1-79455 | | 5/1989 |
| JP | 1-79456 | | 5/1989 |
| JP | 2-4541 | | 1/1990 |
| JP | 3043196 | | 2/1991 |
| JP | 5-95457 | | 12/1993 |
| JP | 6-337 | | 1/1994 |
| JP | 63-26131 | Y2 | 11/1994 |
| JP | 7-24257 | U | 5/1995 |
| JP | 08-336493 | | 12/1996 |
| JP | 10-43116 | | 2/1998 |
| JP | 10-117985 | A | 5/1998 |
| JP | 10-225409 | | 8/1998 |
| JP | 10-328107 | A1 | 12/1998 |
| JP | 10-328107 | A1 | 12/1998 |
| JP | 11-000298 | | 1/1999 |
| JP | 11-089-766 | | 4/1999 |
| JP | 11-276402 | A | 10/1999 |
| JP | 2000-201875 | | 7/2000 |
| JP | 2002-165742 | | 6/2002 |
| WO | 02/34101 | | 5/2002 |

OTHER PUBLICATIONS

English translation of JP 61-177575, Tanaka et al., Nov. 6, 1986.*
Supplementary European Search Report dated Aug. 3, 2006 issued for corresponding European Patent Application No. EP0273346.

* cited by examiner

HANDY MOP

CROSS REFERENCE TO THE PRIOR APPLICATION

This is a U.S. national phase application under 35 U.S.C. §371 of International Patent Application No. PCT/JP01/09377, filed Oct. 25, 2001, and claims the benefit of Japanese Patent Application No. 2000-328865, filed Oct. 27, 2000 and Japanese Application No. 2001-317660, filed Oct. 16, 2001. The International Application was published in English on May 2, 2002 as WO 02/34101 Al under PCT Article 21(2).

BACKGROUND OF THE INVENTION

1. Field of the Invention

The present invention relates to a handy mop which can be used for cleaning operation to remove dust in a room, car or the like.

2. Description of the Related Art

The handy mop of this type is generally constructed by attaching a mop body to a handle for use. Such a mop body used to be of a reusable type that can be washed after stained. However, in recent years, a disposable type of mop body has become to be widely used in combination with a handle to which the disposable mop body is attached.

In the above-mentioned conventional handy mop which is composed of the disposable mop body and the handle to which the disposable mop body is attached, the mop body, after insertion of the solid handle, is clamped on the handle by means of spring or fixed on the handle by means of a rubber molded component, thereby preventing the mop body from being detached from handle during use. However, such means for preventing detachment of the mop body during use causes trouble in attachment and detachment of the mop body. In addition, since the attachment portion of the handle to which the mop body is attached is of stick shape, it may cause damages when comes into contact with furniture or the like during cleaning operation.

SUMMARY OF THE INVENTION

The present invention has been worked out in view of the shortcoming in the prior art set forth above. It is therefore an object of the present invention to provide a handy mop, which hardly causes damages during cleaning operation, and which permits simple attachment and detachment of a mop body while preventing detachment of the mop body during use.

According to the present invention, there is provided a handy mop comprising a mop body for collecting dust and a handle to which the mop body is to be attached, the mop body being provided with two gaps extending in parallel for attachment of the handle thereto, the handle being provided with an attachment portion and a gripper extending rearwardly upwardly from a root end of the attachment portion, the attachment portion being bifurcated at the root end to provide two insert plates, which are flat and level, and are to be inserted into the gaps of the mop body for use.

Preferably, a leading end of each insert plate is rounded off.

Preferably, the handle is further provided with a clamping plate projecting from the root end of the attachment portion in between the two insert plates, a leading end of the clamping plate being upwardly inclined, the clamping plate being provided on a bottom surface thereof with a catch portion.

Preferably, each insert plate is provided on an edge thereof with at least one protrusion. In this case, preferably, each gap of the mop body is provided with a widened region for accommodating the protrusion of each insert plate of the handle.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of a handy mop according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscurity of the present invention.

Figure 1:
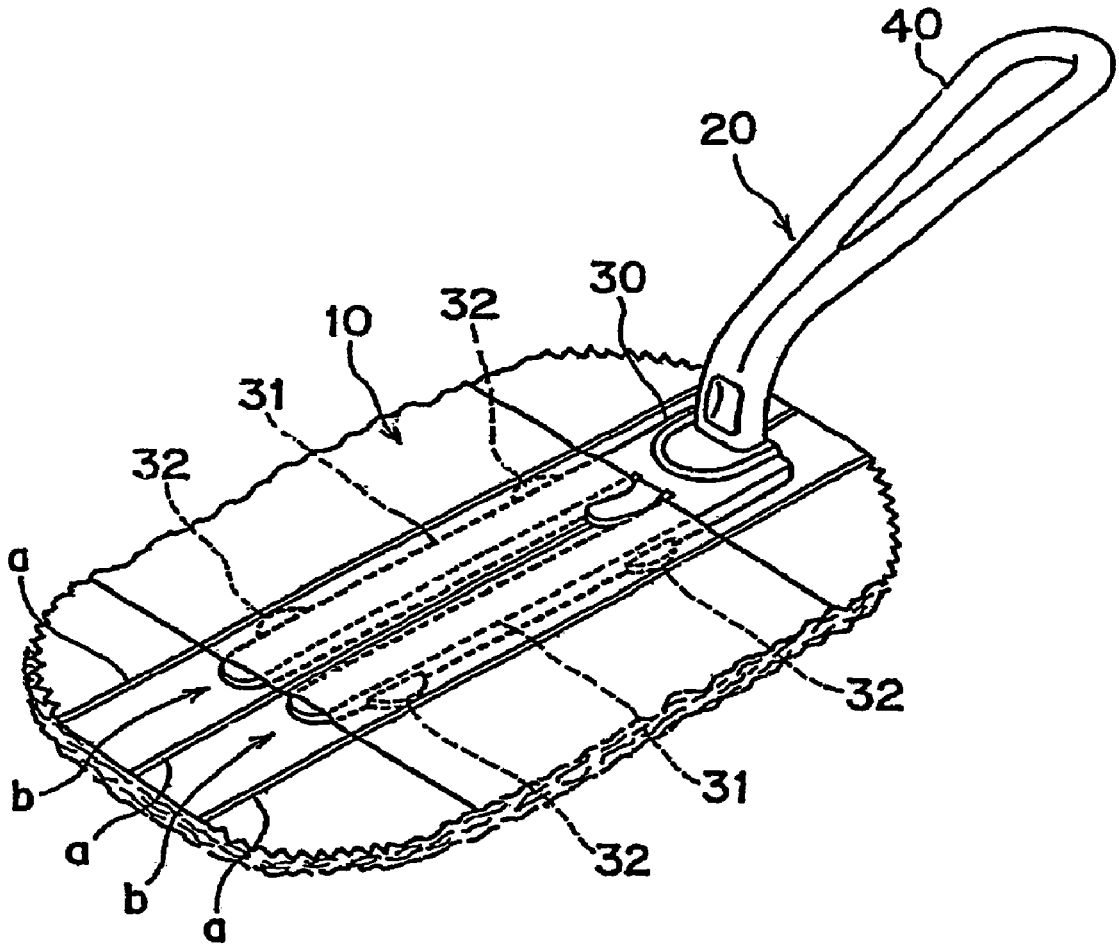
FIG. 1 is a perspective view showing a handy mop according to one embodiment of the present invention.

FIG. 1 is a perspective view showing a handy mop according to one embodiment of the present invention. The handy mop shown in FIG. 1 is composed of a mop body 10 and a handle 20 to which the mop body 10 is to be attached.

The mop body 10 comprises two or three fluffed nonwoven fabrics made of synthetic resin, which are stacked one on another and are then welded on lines extending across the mop body 10. The mop body 10 is further provided at its upper side with another nonwoven fabric shorter than the stacked nonwoven fabrics. As shown in FIG. 1, the shorter nonwoven fabric is laid on the center portion of the stacked nonwoven fabrics and welded thereto on three lines "a" extending in a longitudinal direction of the mop body 10. These three weld lines "a" define two parallel gaps "b" for attachment therebetween.

Figure 2:
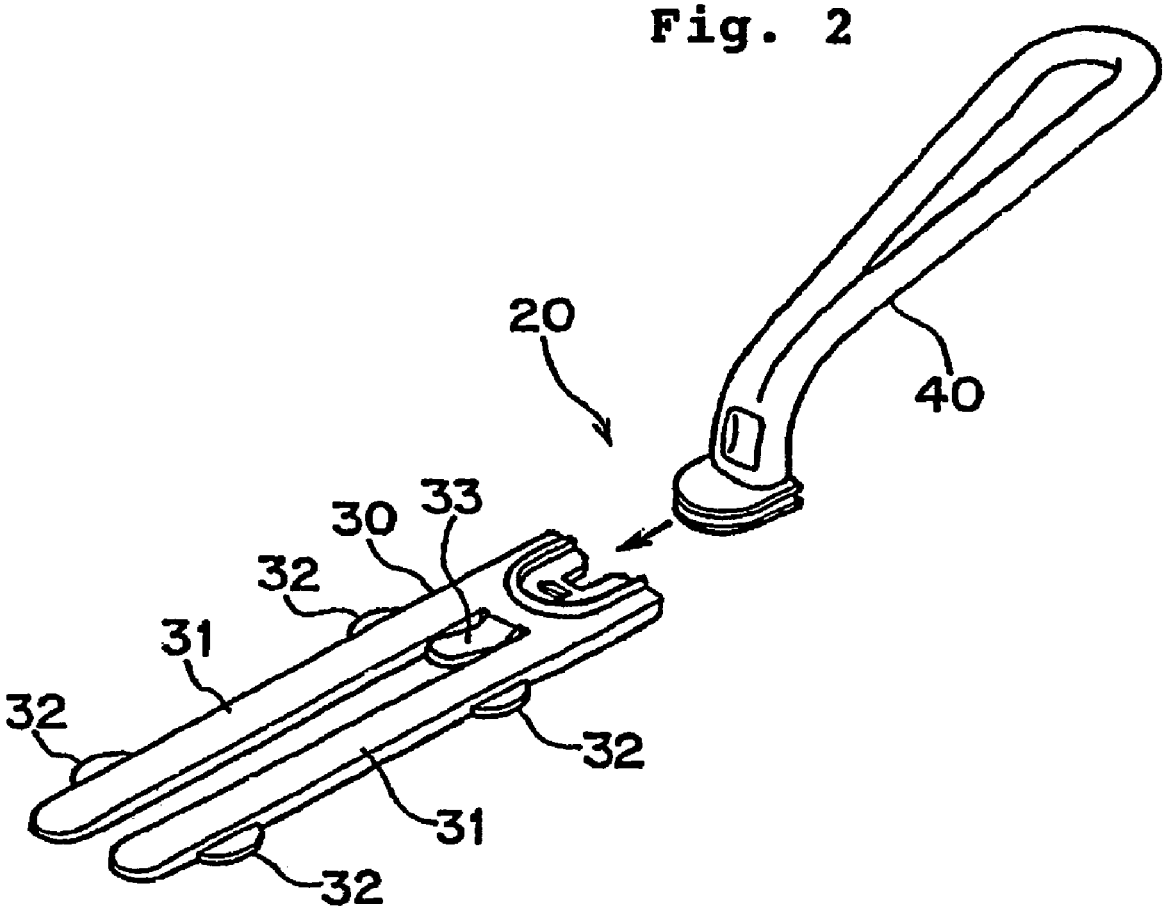
FIG. 2 is a perspective view showing a handle of the handy mop of FIG. 1 in a disassembled state.
Figure 3A:
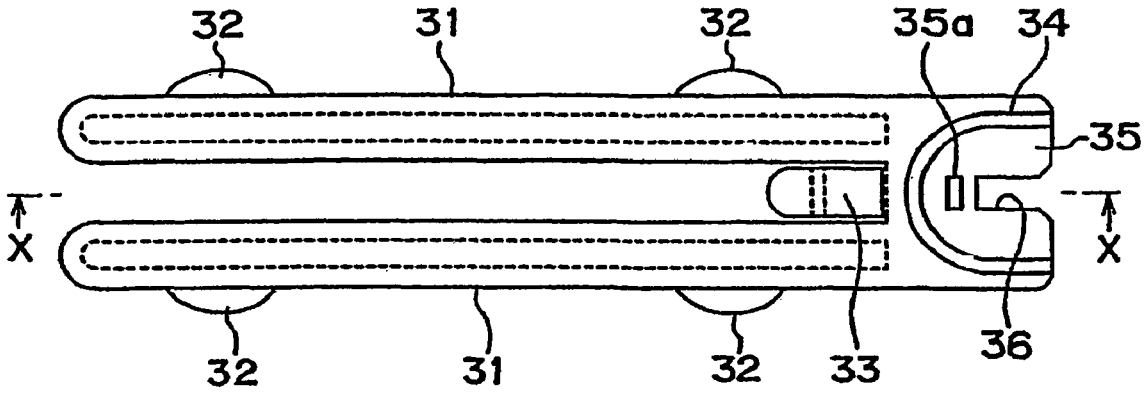
FIG. 3A is a top plan view of an attachment portion of the handle.
Figure 3B:
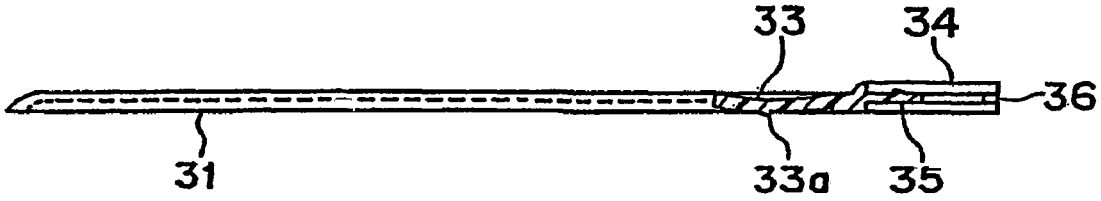
FIG. 3B is a sectional view taken along line X-X of FIG. 3A.
Figure 3C:
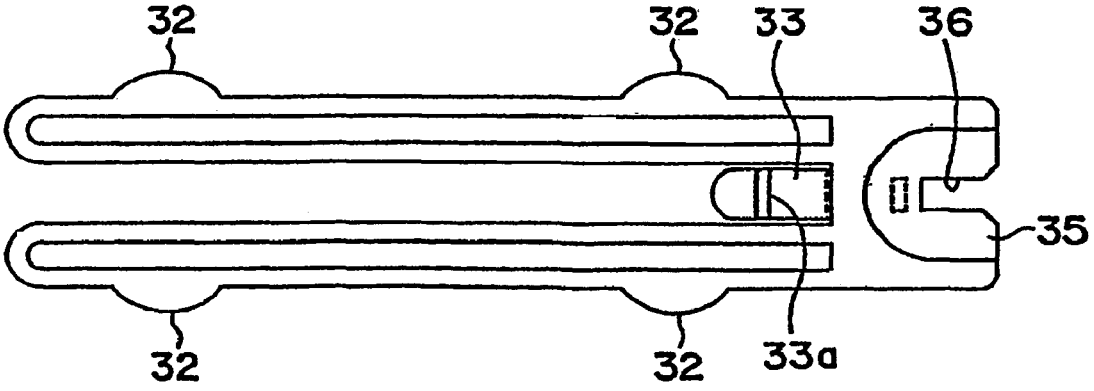
FIG. 3C is a bottom plan view of the attachment portion.
Figure 4A:
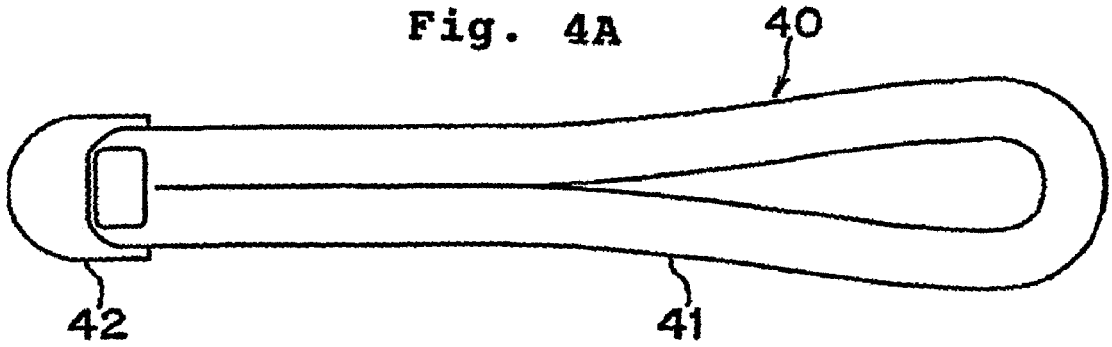
FIG. 4A is a top plan view of a gripper of the handle.
Figure 4B:
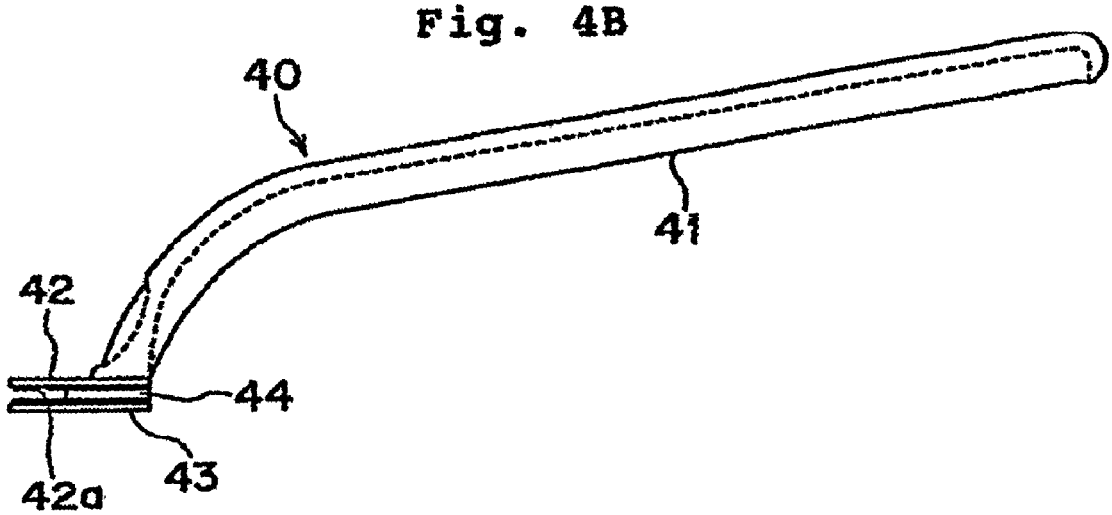
FIG. 4B is a side elevation of the gripper.
Figure 4C:
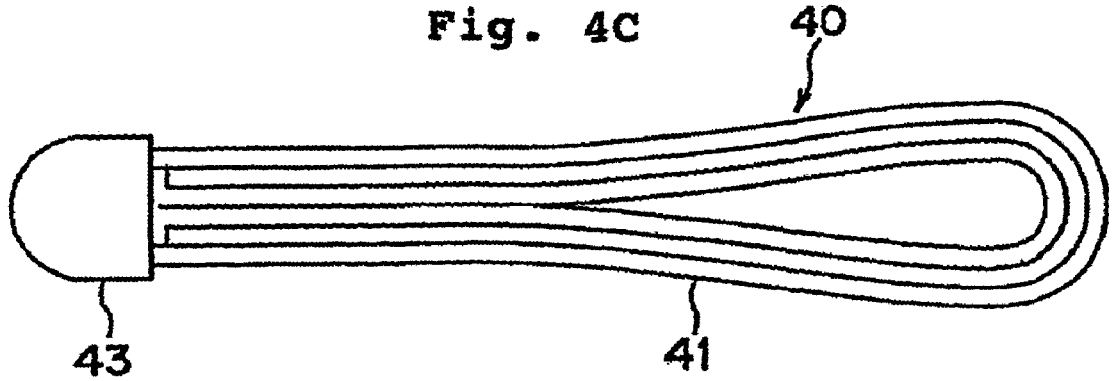
FIG. 4C is a bottom plan view of the gripper.

As shown in FIG. 2, the handle 20 is composed of an attachment portion 30 which is made of synthetic resin, and a gripper 40 which is likewise made of synthetic resin and is to be fixed to the root end of the attachment portion 30 by fit. Of these, the attachment portion 30 is bifurcated at its root end to provide two insert plates 31, which are flat and level, as shown in FIGS. 3A, 3B and 3C. The thickness of the insert plates 31 may be determined in accordance with their length so that the insert plates 31 may cause appropriate resilient flexure upon receiving pressure. On the other hand, as shown in FIGS. 4A, 4B and 4C, the gripper 40 is of a shape to extend rearwardly and upwardly from the root end of the attachment portion 30 when it fits on the attachment portion 30. From the point of view of handleability, the length of the gripper 40 as viewed in plan configuration is preferably 10 to 20 cm or so. Both the attachment portion 30 and the gripper 40 are preferably made of polypropylene.

The leading end of each insert plate 31 of the attachment portion 30 is rounded off (i.e., curved). Preferably, the leading end is curved not only in plan configuration but also in vertical section configuration. In consideration of easy insertion of the insert plates 31 into gaps "b" of the mop body 10, the leading end is preferably curved in vertical section configuration such that the radius of curvature on the upper side thereof is much larger than that on the lower side thereof.

Moreover, each insert plate 31 is provided at its outer edge with two arcuate protrusions 32. These protrusions 32 come into contact with the weld lines "a" upon insertion of the insert plates 31, thereby serving as stopper. Here, the number and location of the protrusions 32 may be appropriately selected in consideration of the effect of preventing detachment and easy insertion, as long as each insert plate 31 has at least one protrusion 32 at either of the outer edge and the inner edge.

The handle 20 is further provided with a clamping plate 33 projecting from the root end of the attachment portion 30 in between the two insert plates 31. The leading end of the clamping plate 33 is upwardly inclined, and the clamping plate 33 is provided on its bottom surface with a catch portion 33*a*.

The root end of the attachment portion 30 has a semicircular thin portion 35, which is enclosed by a flange 34 on the top surface of the root end and is formed with a cut-out 36. On the other hand, the gripper 40 is provided at the leading end of a grip portion 41 with a fitting structure composed of an upper plate portion 42 and a lower plate portion 43. When the thin portion 35 of the attachment portion 30 is inserted in between the plate portions 42 and 43 of the gripper 40, a connecting portion 44 between the plate portions 42 and 43 mates with the cut-out 36, and in conjunction therewith, a groove 42*a* formed in the lower surface of the upper plate portion 42 mates with a protrusion 35*a* of the thin portion 35, so that the attachment portion 30 is fixed to the gripper 40.

The handy mop having the above-described construction is assembled for use into a state shown in FIG. 1, by assembling the handle 20 from the attachment portion 30 and the gripper 40 and by attaching the mop body 10 to the handle 20 thus assembled.

Figure 5:
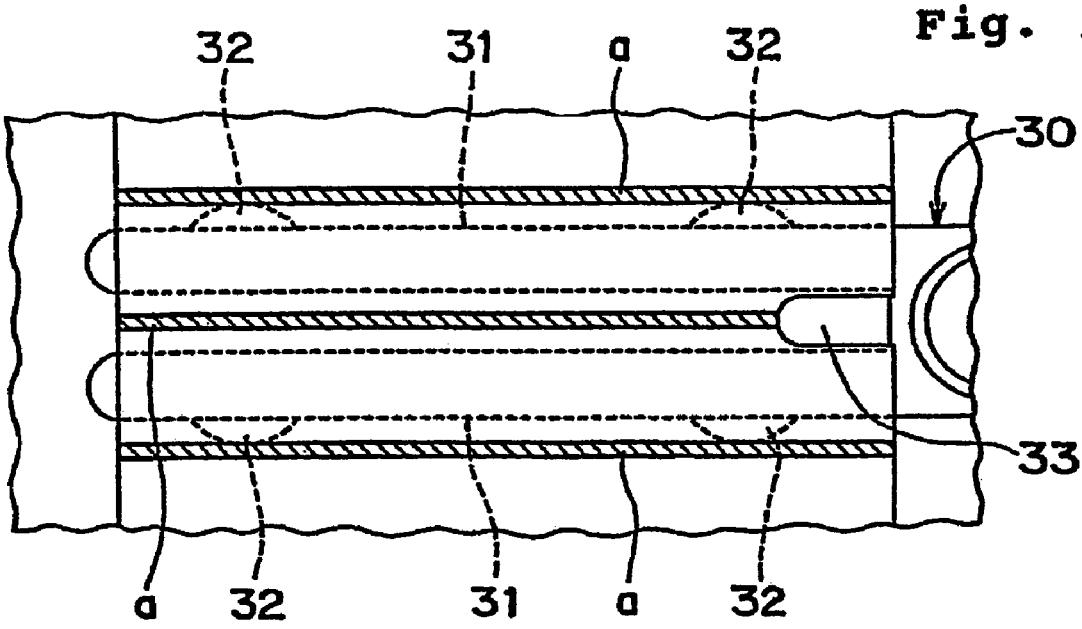
FIG. 5 is an illustration showing a state where the mop body is attached to the handle.

For attaching the mop body 10 to the handle 20, the insert plates 31 of the attachment portion 30 are inserted into the gaps "b" disposed on the upper side of the mop body 10. Here, the insert plates 31 may be inserted into the gaps "b" from either side of the mop body 10. In the course of insertion, the protrusions 32 of the insert plates 31 are brought into contact with the outside weld lines "a", and lastly, the clamping plate 33 disposed between the insert plates 31 runs upon the central weld line "a". Thus, the attachment is completed in such a state as in FIG. 5. In this attached state, since the protrusions 32 of the insert plates 31 are kept in contact with the outside weld lines "a" and the clamping plate 33 has the catch portion 33*a* on its bottom surface, the detachment of the mop body 10 from the handle 20 can be effectively prevented.

Figure 6A:
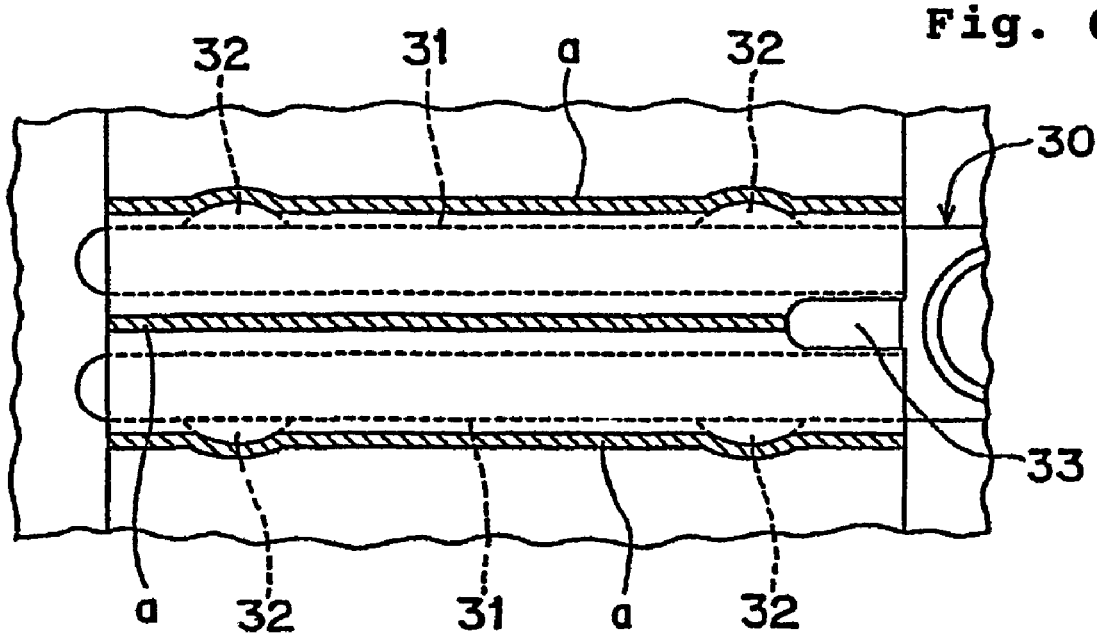
FIGS. 6A and 6B are illustrations showing a state where other types of mop body are attached to the handle.
Figure 6B:
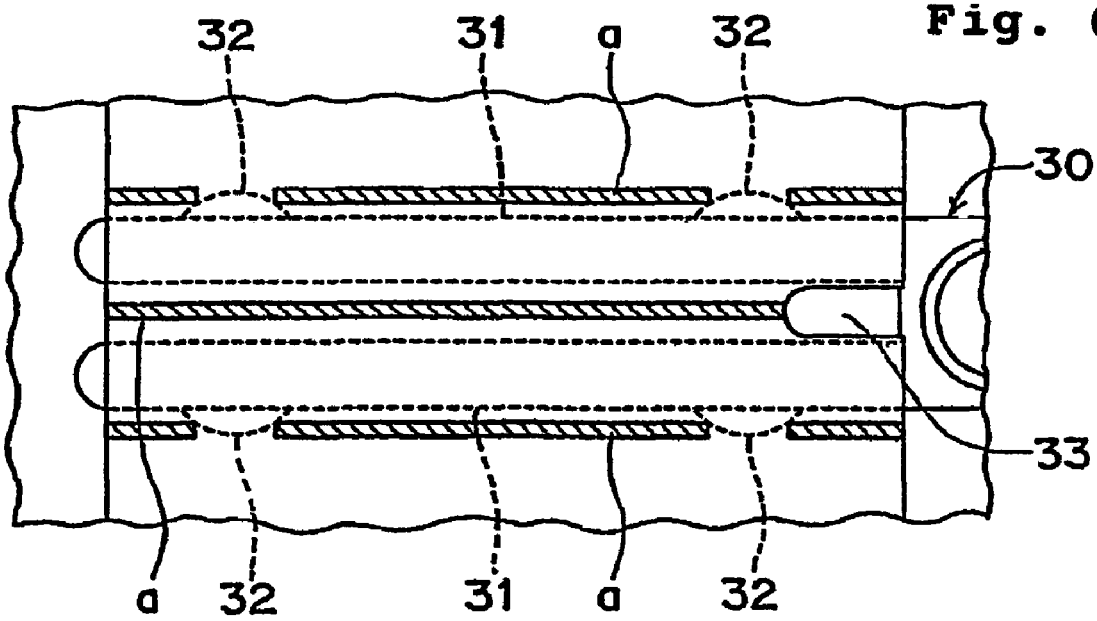

FIGS. 6A and 6B are illustrations showing a state where, other types of mop body having widened regions formed in gaps are attached to the handle. FIG. 6A shows the case where the weld lines "a" are bulged convexly outwardly at locations corresponding to the protrusions 32 of the insert plates 31. On the other hand, FIG. 6B shows the case where the weld lines "a" are interrupted at locations corresponding to the protrusions 32 of the insert plates 31. With the widened regions thus formed in the gaps for insertion, the protrusions 32 of the insert plates 31 in an attached state mate with the bulged portions or interrupted portions of the weld lines "a", as shown in FIG. 6A or 6B, which prevents detachment of the mop body 10 more effectively.

Although the present invention has been described in detail with respect to exemplary embodiment thereof, the handy mop of the present invention should not be understood as limited to the specific embodiment set out above but various changes may be made therein, without departing from the spirit of the present invention.

For example, the mop body may be of any type as long as it has two gaps for attachment.

Although the handle of the above-described embodiment is composed of two components of fitting type so as to make the handle compact when it is not used, it may, of course, be possible that the handle is composed of a single component.

As a result of the various structures described in detail above, advantages of the invention may include one or more of the following:

(1) The mop body is hardly detached from the handle during use but can be attached to or detached from the handle by a single operation;

(2) The flat insert plates to which the mop body is attached cause resilient flexure upon receiving pressure so that they do not damage an object to be cleaned;

(3) In case where the leading end of each insert plate is rounded off, the insert plates can be smoothly inserted into the gaps of the mop body without being caught therein;

(4) In case where the handle is provided with the clamping plate projecting from the root end of the attachment portion in between the two insert plates, the leading end of the clamping plate is upwardly inclined, and the clamping plate is provided on the bottom surface thereof with the catch portion, when the insert plates are inserted into the gaps of the mop body, the clamping plate between the insert plates runs upon the central weld line, pressing the mop body to maintain it in an attached state, which prevents detachment of the mop body more effectively;

(5) In case where each insert plate is provided on the edge thereof with at least one protrusion, when the insert plates are inserted into the gaps of the mop body, the protrusions of the insert plates come into contact with the outside weld lines, which prevents detachment of the mop body more effectively; and (6) In case where each gap of the mop body is provided with the widened region for accommodating the protrusion of each insert plate of the handle, when the insert plates are inserted into the gaps of the mop body, the protrusions of the insert plates mate with the widened regions, which prevents detachment of the mop body more effectively.

The invention claimed is:

1. A handy mop comprising:

a mop body including a first fabric component and a second fabric component stacked on said first fabric component and adhered thereto at three parallel joints, said three parallel joints comprising two outside joints and one middle joint located in between said two outside joints;

two parallel gaps provided side by side on an upper side of said mop body, one of said two gaps being defined by one of said two outside joints and said middle joint, the other of said two gaps being defined by the other of said two outside joints and said middle joint, and a handle to which said mop body is to be attached, said handle being provided with an attachment portion to which said mop body is to be attached and a gripper extending rearwardly upwardly from said attachment portion, said attachment portion being formed to have:

two flat flexible insert plates adapted to be inserted into said two gaps of said mop body, respectively, said insert plates extending in a direction from a base end of said attachment portion and having top surfaces flush with each other; and a clamping plate provided between said two insert plates, extending in the same direction as said two insert plates from said base end of said attachment portion, said clamping plate extending shorter than said insert plates, the clamping plate having a bottom surface located below said top surfaces of said two insert plates, wherein when said insert plates are inserted into said gaps, said bottom surface of said clamping plate lies on said middle joint of said mop body;

said two flat flexible insert plates extend through a portion of said two gaps distally positioned away from said clamping plate, and said two flexible insert plates come into contact with said distally positioned portion of said two gaps in said portion at said outside joints, wherein said contact causes said two flat flexible insert plates to exert a resilient force directed outwardly toward said outside joints.

2. The handy mop as set forth in claim 1, wherein a leading end of said clamping plate is upwardly inclined.

3. The handy mop as set forth in claim 1, wherein said clamping plate has a catch portion on said bottom surface.

4. The handy mop as set forth in claim 3, wherein said catch portion of said clamping plate is located below bottom surfaces of said two insert plates.

5. The handy mop as set forth in claim 1, wherein each insert plate is provided with at least one protrusion on an edge thereof.

6. The handy mop as set forth in claim 5, wherein when said insert plates are inserted into said gaps, said protrusion of each insert plate comes into contact with one of said joints.

7. The handy mop as set forth in claim 1, wherein said insert plates are adapted to cause resilient flexure upon pressing with thickness determined in accordance with length.

8. A handy mop comprising:

a mop body having two gaps substantially parallel to each other; and a handle having an attachment portion to which the mop body is to be attached, and a gripper extending from a base end portion of the attachment portion, wherein the attachment portion is formed with a pair of flexible insert plates extending from the base end portion to be inserted into the two gaps of the mop body, respectively, and at least one of the pair of flexible insert plates has at least two protrusions provided along a longitudinal direction of the insert plates, adapted to be accommodated in one of the two gaps into which the at least one of the pair of flexible insert plates is inserted with said at least two protrusions being adapted to protrude toward an outside joint positioned at a lateral edge of the one gap, and the at least one of the pair of the flexible insert plates has an increased cross-sectional area in a plane that is perpendicular to the longitudinal direction of the insert plates at a location of at least one of the protrusions; and wherein, the protrusions are formed on outer edges of the at least one of the pair of flexible insert plates, and the pair of flexible insert plates have a first pair of the protrusions to provide a first expanded width of the attachment portion near a distal end of the attachment portion, and a second pair of the protrusions to provide a second expanded width of the attachment portion near the base end portion of the attachment portion, and the first expanded width of the attachment portion is substantially same as the second expanded width of the attachment portion, and the gaps of the mop body are defined between joints where components of the mop body are adhered to each other, and the joints are bulged convexly outwardly or interrupted at locations corresponding to the protrusions to thereby form widened regions in the gaps for receiving the protrusions.

9. The handy mop according to claim 8, wherein the gaps of the mop body are defined between substantially parallel joints where components of the mop body are adhered to each other, and a width between outermost ones of the parallel joints is substantially same as the first and second expanded widths of the attachment portion.

10. The handy mop according to claim 8, wherein the first and second pairs of the protrusions are to be located at both ends in a longitudinal direction of the gaps, respectively, when the first and second pairs of the protrusions are accommodated in the gaps.

11. The handy mop according to claim 8, wherein each of the protrusions is formed to have an arcuate edge.

12. The handy mop according to claim 8, wherein each of the pair of flexible insert plates is formed in flat shape.

13. The handy mop according to claim 12, wherein the pair of the flexible insert plates are formed to have top surfaces flush with each other.

* * * * *